US009203163B2

(12) United States Patent
Merrick et al.

(10) Patent No.: US 9,203,163 B2
(45) Date of Patent: Dec. 1, 2015

(54) ANTENNA ASSEMBLY

(75) Inventors: Michael Merrick, Novi, MI (US); Matthew Gordon Gray, Novi, MI (US); Ervin Larashi, Novi, MI (US); Rus Leelaratne, Sittingbourne (GB); Richard Breden, Sittingbourne (GB)

(73) Assignee: Harada Industry Of America, Inc., Novi, MI (US)

( * ) Notice: Subject to any disclaimer, the term of this patent is extended or adjusted under 35 U.S.C. 154(b) by 478 days.

(21) Appl. No.: 13/400,970

(22) Filed: Feb. 21, 2012

(65) Prior Publication Data

US 2012/0218155 A1 Aug. 30, 2012

Related U.S. Application Data

(60) Provisional application No. 61/446,722, filed on Feb. 25, 2011.

(51) Int. Cl.
*H01Q 1/32* (2006.01)
*H01Q 21/28* (2006.01)
*H01Q 9/42* (2006.01)

(52) U.S. Cl.
CPC ..... *H01Q 21/28* (2013.01); *H01Q 1/3283* (2013.01); *H01Q 9/42* (2013.01)

(58) Field of Classification Search
CPC ..... H01Q 1/3283; H01Q 21/28; H01Q 9/42
USPC ..... 343/700 MS, 711, 712, 713
See application file for complete search history.

(56) References Cited

U.S. PATENT DOCUMENTS

| | | | | |
|---|---|---|---|---|
| 6,525,691 | B2 | 2/2003 | Varadan et al. | |
| 6,664,932 | B2 | 12/2003 | Sabet et al. | |
| 7,821,465 | B2 | 10/2010 | Rozan | |
| 7,868,834 | B2 | 1/2011 | Ortigosa et al. | |
| 2004/0119644 | A1 * | 6/2004 | Puente-Baliarda et al. MS | 343/700 |
| 2007/0182651 | A1 * | 8/2007 | Grant et al. | 343/713 |
| 2009/0066600 | A1 | 3/2009 | Rabinovich | |
| 2009/0237313 | A1 * | 9/2009 | Martinez Ortigosa | 343/713 |
| 2010/0265141 | A1 | 10/2010 | Hsu | |

FOREIGN PATENT DOCUMENTS

| | | | |
|---|---|---|---|
| FR | 2896625 | A3 | 7/2007 |
| WO | 2009004449 | A3 | 1/2009 |

* cited by examiner

*Primary Examiner* — Hoanganh Le
(74) *Attorney, Agent, or Firm* — Dickinson Wright PLLC

(57) ABSTRACT

An antenna assembly for a vehicle including an environmentally sealed housing and a printed circuit board. The printed circuit board is at least partially disposed within the environmentally sealed housing and extends through a plurality of second order Hilbert Curves which are arranged in side-by-side relationship with one another. The antenna assembly is preferably disposed within a non-metallic structure of the vehicle, and therefore, the antenna assembly is hidden from view, thereby allowing the vehicle to have a more aesthetically pleasing external appearance. Additionally, the length of the trace is limited by the space inside of the non-metallic structure, and therefore, depending on the size of the non-metallic structure, a very long trace having a high performance could be printed on the printed circuit board.

15 Claims, 9 Drawing Sheets

AM Amplifier Gain

| Freq. (KHz) | Gain (dB) | Spec (dB) |
|---|---|---|
| 530 | 12.7 | ≤13 |
| 1710 | 11.3 | ≤13 |

FM Amplifier Gain

| Freq. (KHz) | Gain (dB) | Spec (dB) |
|---|---|---|
| 87.9 | 12.8 | ≤13 |
| 107.9 | 11.2 | ≤13 |

FIG. 10

Amplifier Noise

| Freq. (KHz) | Noise Figure (dB) | Spec (dB) |
|---|---|---|
| 87.9 | 2.4 | ≤ 5 |
| 107.9 | 2.1 | ≤ 5 |

FIG. 11

FM Passive Gain

| | Vertical LAG (dBr) | Horizontal LAG (dBr) | HV Comb. LAG (dBr) | Vertical Max/Min (dBr) | Horizontal Max/Min (dBr) | HV Comb Max/Min (dBr) |
|---|---|---|---|---|---|---|
| 88.0 MHz | -17.1 | -21.9 | -17.1 | 4.3 | 20.3 | 4.3 |
| 90.0 MHz | -17.2 | -21.3 | -17.2 | 5.5 | 24.4 | 5.5 |
| 92.0 MHz | -16.4 | -21.3 | -16.4 | 6.4 | 32.3 | 6.4 |
| 94.0 MHz | -16.3 | -21.5 | -16.3 | 6.2 | 31.7 | 6.2 |
| 96.0 MHz | -14.1 | -20.4 | -14.1 | 8.2 | 21.1 | 8.2 |
| 100.0 MHz | -14.9 | -21.4 | -14.8 | 8.3 | 27.7 | 7.9 |
| 102.0 MHz | -14.0 | -20.5 | -13.9 | 11.1 | 21.2 | 10.5 |
| 104.0 MHz | -14.2 | -20.6 | -14.1 | 19.3 | 22.8 | 11.2 |
| 106.0 MHz | -16.0 | -21.3 | -15.8 | 27.9 | 24.1 | 10.0 |
| 107.8 MHz | -16.4 | -22.0 | -16.2 | 23.3 | 25.4 | 11.2 |

FIG. 12

FM Active Gain

| | Vertical LAG (dBr) | Horizontal LAG (dBr) | HV Comb. LAG (dBr) | Vertical Max/Min (dBr) | Horizontal Max/Min (dBr) | HV Comb Max/Min (dBr) |
|---|---|---|---|---|---|---|
| 88.0 MHz | -3.9 | -8.9 | -3.7 | 6.3 | 26.4 | 6.3 |
| 90.0 MHz | -4.4 | -9.4 | -4.3 | 8.2 | 21.0 | 8.2 |
| 92.0 MHz | -3.6 | -9.3 | -3.6 | 9.1 | 15.9 | 9.1 |
| 94.0 MHz | -2.8 | -8.7 | -2.7 | 8.4 | 17.8 | 8.4 |
| 96.0 MHz | -1.1 | -7.5 | -1.0 | 10.3 | 16.2 | 10.1 |
| 100.0 MHz | -2.3 | -7.6 | -2.1 | 8.8 | 14.5 | 8.5 |
| 102.0 MHz | -1.9 | -7.1 | -1.7 | 9.2 | 14.6 | 8.8 |
| 104.0 MHz | -2.5 | -8.1 | -2.4 | 9.2 | 13.0 | 8.8 |
| 106.0 MHz | -4.9 | -9.3 | -4.8 | 8.0 | 11.5 | 8.0 |
| 107.8 MHz | -5.4 | -10.8 | -5.4 | 8.4 | 12.6 | 8.4 |

FIG. 13

AM Passive Gain *

| | Reference Level | Vehicle Level | Gain |
|---|---|---|---|
| 560 kHz | -68.4 | -73.3 | -4.9 |
| 760 kHz | -49.2 | -54.5 | -5.3 |
| 1270 kHz | -73.1 | -77.8 | -4.6 |
| 1600 kHz | -67.6 | -72.9 | -5.3 |

*Antenna element mounted on the outside of the spoiler

FIG. 14

AM Active Gain

| | Reference Level | Vehicle Level | Gain |
|---|---|---|---|
| 560 kHz | -75.8 | -85.5 | -9.7 |
| 760 kHz | -58.5 | -66.9 | -8.4 |
| 1270 kHz | -76.1 | -85.6 | -9.5 |
| 1600 kHz | -73.9 | -83.3 | -9.4 |

FIG. 15

ANTENNA ASSEMBLY

CROSS REFERENCE TO RELATED APPLICATION

This application claims the benefit of U.S. Provisional Application Ser. No. 61/446,722 filed Feb. 25, 2011, entitled "Antenna Assembly," the entire disclosure of the application being considered part of the disclosure of this application and hereby incorporated by reference.

BACKGROUND OF THE INVENTION

1. Field of the Invention

The present invention relates to an antenna for a vehicle. More specifically, the present invention relates to a printed circuit board fractal antenna.

2. Description of the Prior Art

Traditionally, radio antennas are disposed on the exterior of the vehicle and in the plain view of both the driver and others outside of the vehicle, which some people consider to be visually unappealing. In order to enhance the external appearance of their vehicles, some automobile manufacturers have developed antennas that are built into the rear windshields of their vehicles. However, such glass-embedded antennas must be small to avoid interfering with the driver's visibility through the rear windshield and also to avoid interfering with the heating (defrosting) elements which are also typically disposed on rear windshields. Such size constraints may compromise glass-embedded antenna's performance.

There remains a significant and continuing need for an improved antenna assembly that is cost effective, hidden from view and large enough to offer maximum performance.

SUMMARY OF THE INVENTION

At least one aspect of the present invention provides for an antenna assembly including an environmentally-sealed housing for disposal inside of a non-metallic structure of a vehicle, e.g. a bumper, a spoiler, an air dam or a deck lid. A printed circuit board is disposed at least partially within the housing, and the printed circuit board includes a trace extending in a longitudinal direction through a plurality of second order Hilbert Curves. The trace is configured to receive amplitude modulation (AM), frequency modulated (FM) and/or high definition (HD) radio signals. Because the antenna assembly is disposed within the non-metallic structure of the vehicle, it is out of sight for the driver and others outside of the vehicle, thus allowing for the vehicle to have a more aesthetically appealing exterior appearance. Further, the antenna assembly can be as large as the non-metallic structure within which it is disposed and is not limited to the constraints of the rear windshield. Thus, the trace may be made longer than other comparable glass-embedded antennas which could lead to improved performance without the drawbacks associated with glass-embedded antennas discussed above.

The antenna assembly is also beneficial because it can be used in any type of vehicle, thus allowing for cost savings through manufacturing of scale. For example, the same antenna assembly could be placed in a deck of a sport utility vehicle, the spoiler of a sports car or the bumper of a large passenger vehicle.

Additionally, through simple adjustments, the antenna assembly can also be reconfigured to optimize its performance in any type of vehicle. For example, the material of the trace, the width of the trace, the number of Hilbert Curves through which the trace extends or the dimensions of the Hilbert Curves could all be modified for any particular vehicle. Any of these modifications could have an impact on the performance of the antenna assembly, and the cost of any of these changes could be very small.

According to another aspect of the present invention, an additional trace is printed on the printed circuit board opposite of the trace with the Hilbert Curves. The additional trace can be configured for receiving, for example, remote keyless entry signals and/or digital audio band (DAB) radio signals. Thus, the additional functionality of having an externally mounted remote keyless entry antenna and/or DAB antenna is gained with the only additional cost being the printing of a second trace on the printed circuit board. The additional trace is printed on the side of the board opposite of the first trace discussed above for minimizing the size of the printed circuit board, and thus the entire antenna assembly.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 10 is a table showing AM and FM amplifier gain tests of the antenna assembly;

FIG. 11 is a table showing the FM amplifier noise tests of the antenna assembly;

FIG. 12 is a table showing the results of FM passive gain tests of the antenna assembly;

FIG. 13 is a table showing the results of FM active gain tests of the antenna assembly;

FIG. 14 is a table showing the results of AM passive gain tests of the antenna assembly; and FIG. 15 is a table showing the results of AM active gain tests of the antenna assembly.

DETAILED DESCRIPTION OF THE ENABLING EMBODIMENTS

Figure 1:
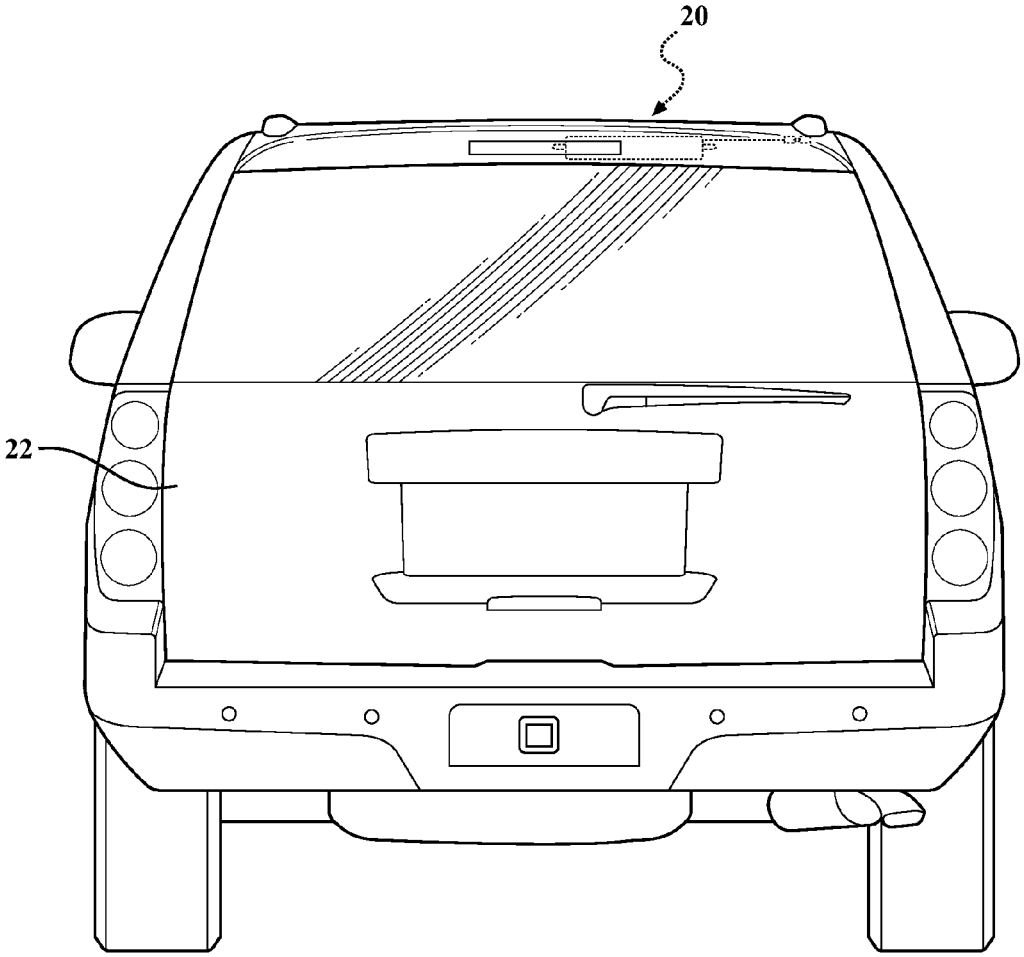
FIG. 1 is a rear view of a typical sport utility vehicle.
Figure 1A:
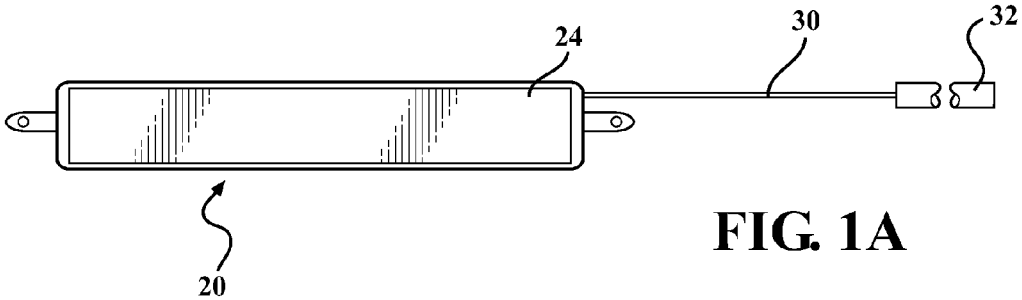
FIG. 1A is a top elevation view of an exemplary antenna assembly for disposal in an air dam of the vehicle of FIG. 1.

Referring to the drawings wherein like numerals indicate corresponding parts throughout the several views, an exemplary antenna assembly 20 is generally shown in FIG. 1A for disposal in the vehicle 22 of FIG. 1. In the exemplary embodiment, the antenna assembly 20 is positioned within an air dam of a typical sport utility vehicle 22, which may result in improved reception since the air dam is so high on the vehicle.

However, it should be appreciated that the antenna assembly 20 could be mounted within a wide variety of non-metallic structures on the vehicle 22, including, for example, a spoiler or a bumper. Although the structure containing the antenna assembly 20 should be non-metallic to allow for maximum performance, a metal ground point is required, as will be discussed in further detail below.

As will be discussed in further detail below, the antenna assembly 20 is configured to receive amplitude modulation (AM), frequency modulation (FM), high definition (HD), digital audio broadcast (DAB) and/or any other type of radio signal. In addition to radios, the antenna assembly 20 can be configured to receive remote keyless entry signals or any other type of signals.

Referring now to FIGS. 2-5, the antenna assembly 20 includes a housing, which is generally indicated at 24, having a generally rectangular shape and including at least one mounting bracket 26 for attachment to the vehicle 22. The exemplary housing 24 is of two pieces, which are connected together through a plurality of screws 28, each of which has a width of approximately 45 mm, a length of approximately 356 mm and a depth of approximately 13 mm. However, it should be appreciated that the housing 24 could take many alternate configurations, shapes and sizes.

Figure 2:
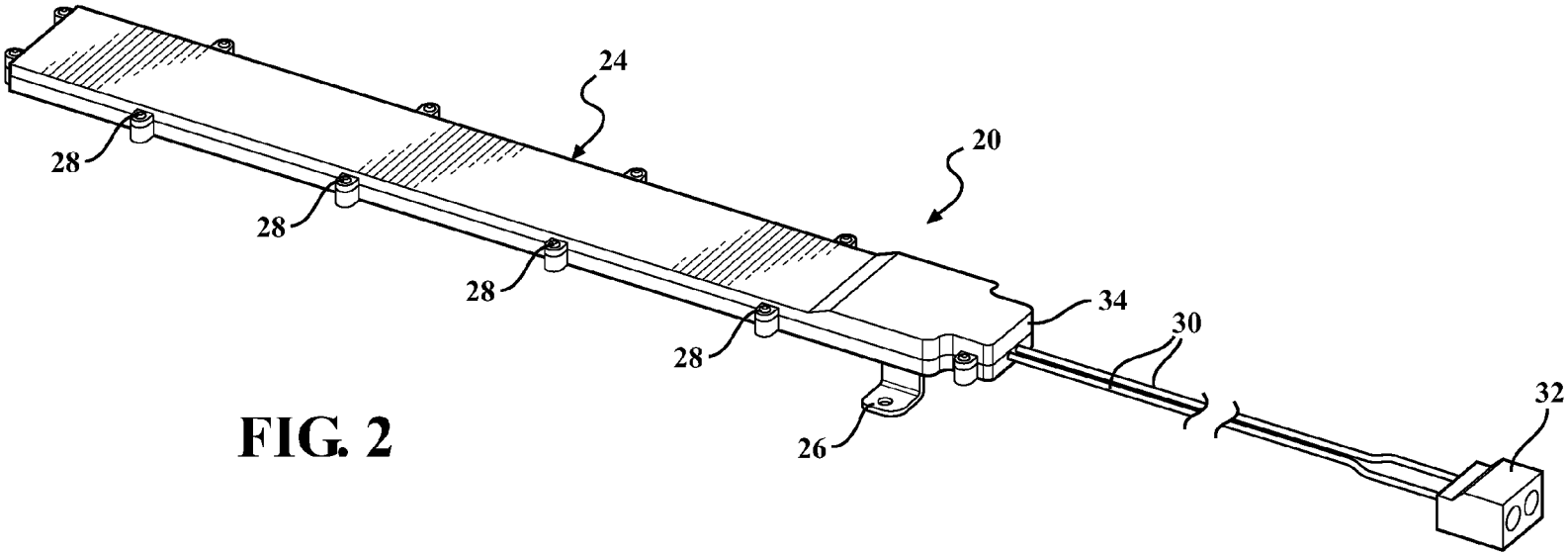
FIG. 2 is a perspective view of the housing of the exemplary antenna assembly.
Figure 3:
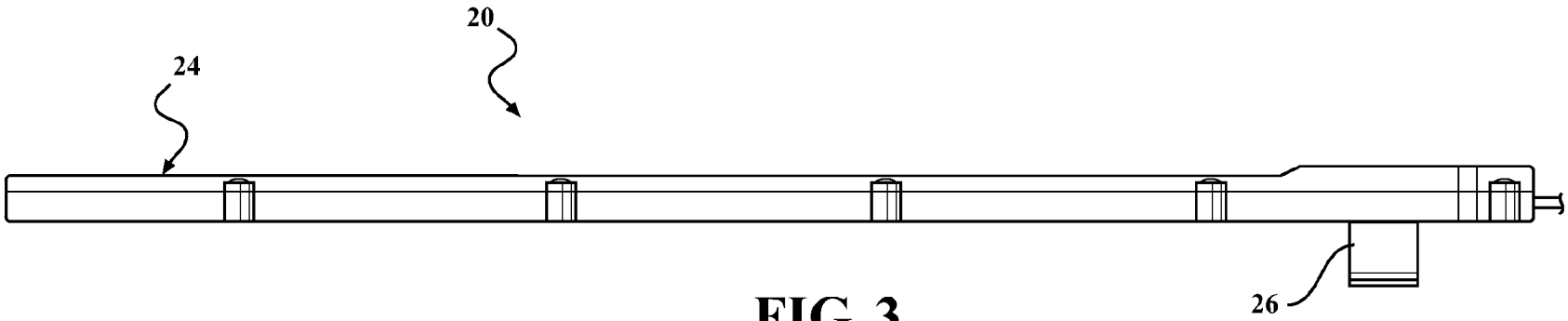
FIG. 3 is a side view of the housing of the exemplary antenna assembly.

As best shown in FIG. 2, a pair of coaxial cables 30 extends through one end of the housing 24 to an electrical connector 32 for connecting the antenna assembly 20 to the electrical wiring of the vehicle 22. A seal 34 is disposed at the location where the coaxial cables 30 exit the housing 24. The housing 24 additionally includes one or more additional seals such that the housing 24 is hermetically sealed from the external environment to protect the components disposed therein (discussed below).

Figure 4:
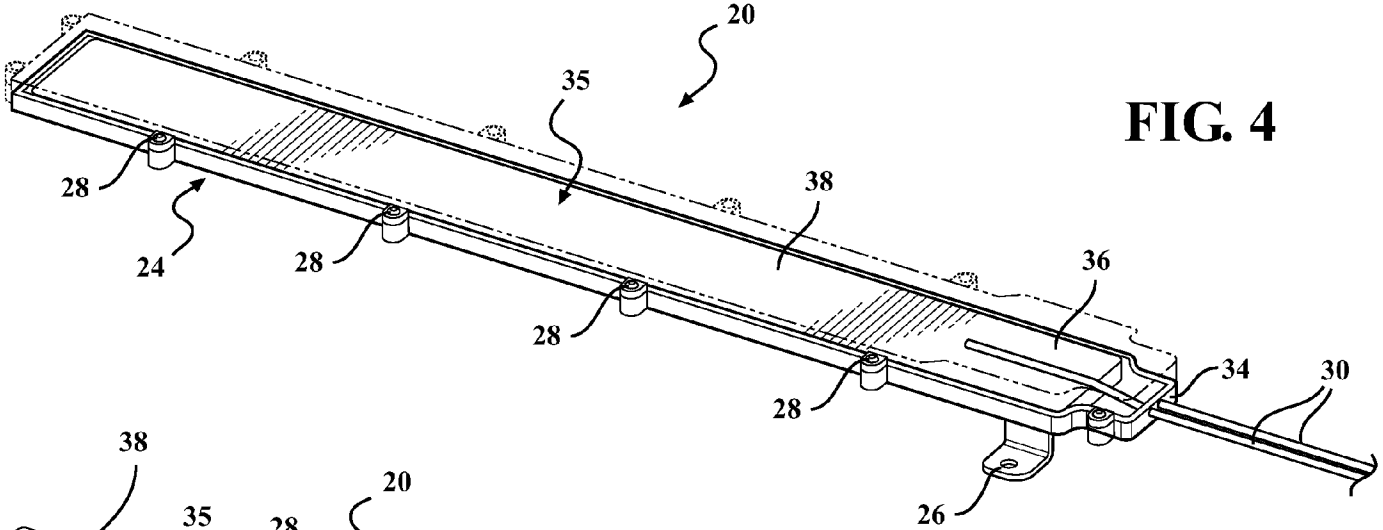
FIG. 4 is a perspective and fragmentary view of the housing with the printed circuit board and the ground plane disposed therein.
Figure 5:
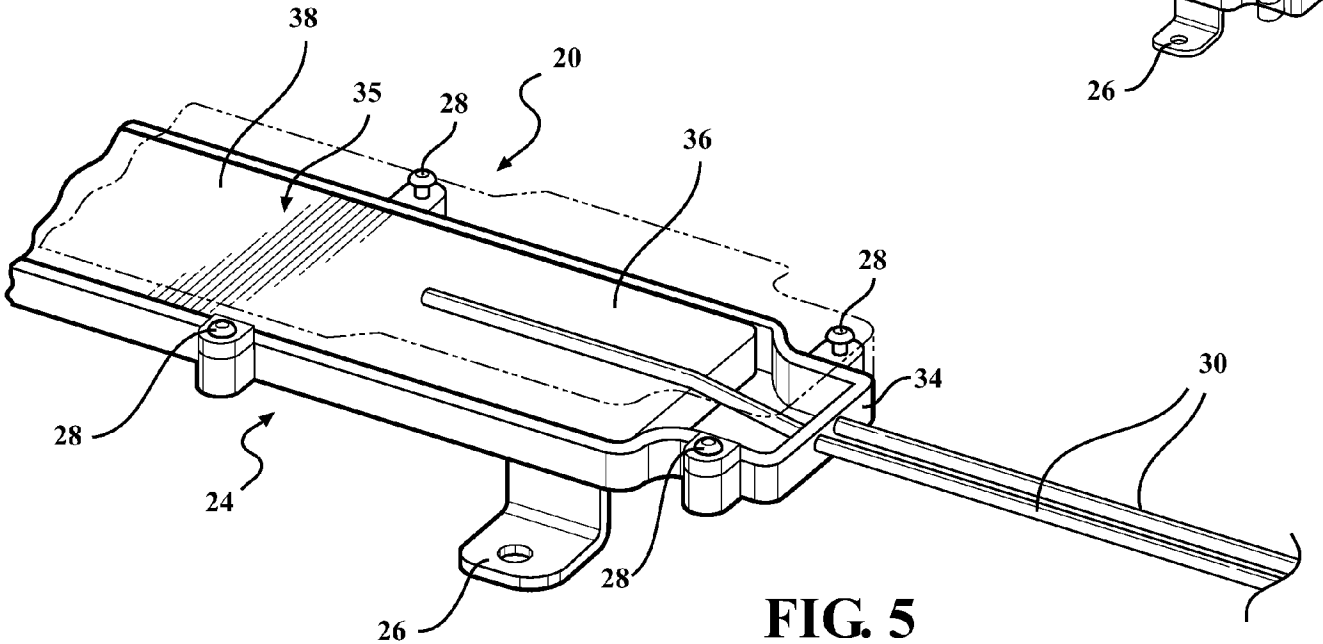
FIG. 5 is a perspective and fragmentary view of the housing of the exemplary antenna assembly with the printed circuit board and the ground plane disposed therein.

Referring now to FIGS. 4 and 5, a printed circuit board 35 having an amplifier section 36 and an antenna section 38 is disposed within the housing 24. The cables 30 are in electrical communication with the printed circuit board 35 for transmitting received and amplified signals to and/or from, for example, a radio in the vehicle. The printed circuit board 35 is also electrically connected to the metal ground point within the non-metallic structure of the vehicle 22. In the exemplary embodiment, the amplifier section 36 has a generally square shape with a length and a width of 30.0 mm; however, it should be appreciated that the amplifier section could have any desirable size and shape.

Figure 6:
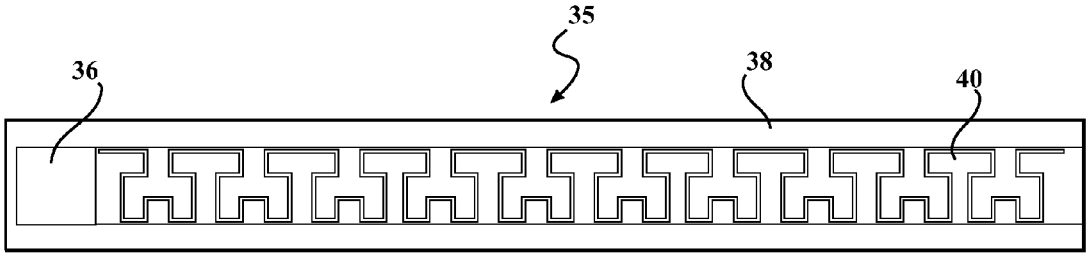
FIG. 6 is a top view of the exemplary printed circuit board.
Figure 7:
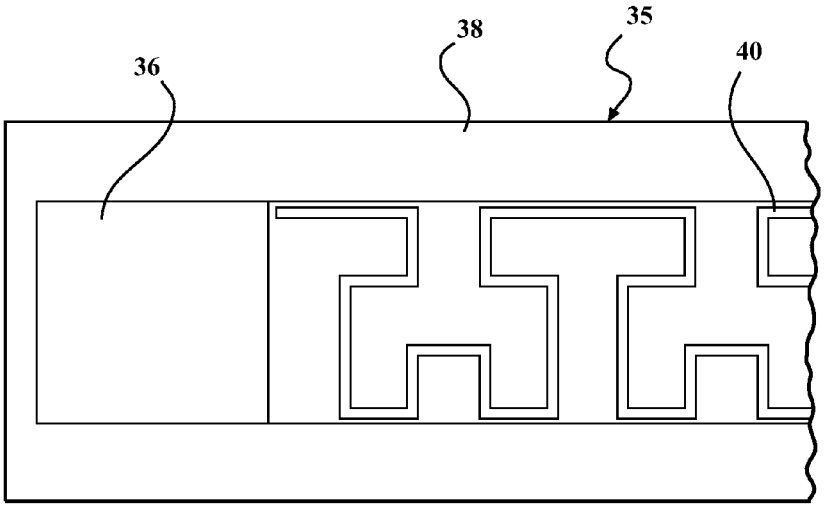
FIG. 7 is a top and fragmentary view of the exemplary printed circuit board.

Referring now to FIGS. 6 and 7, a first trace 40 is printed on a first surface of the antenna section 38 of the printed circuit board 35 for receiving AM, FM and/or HD radio signals. The first trace 40 follows the path of a series of second order Hilbert Curves connected to one another in a longitudinal direction. This particular pattern has been found to provide the first trace 40 with optimal reception of most radio signals in the range of 520 KHz to 180 MHz.

The exemplary first trace 40 is of copper and has a width of approximately 1 mm. Additionally, as best shown in FIG. 6, the exemplary first trace 40 extends through ten second order Hilbert Curves, which are separated from one another in the longitudinal direction by a distance of approximately 36.0 mm and are arranged in side-by-side relationship with one another. The number of Hilbert Curves, the dimensions of the Hilbert Curves, and the width of the first trace 40 on the printed circuit board 35 can be adjusted to maximize the performance of the antenna assembly 20 for any vehicle 22. In other words, with simple modifications to the printing of the first trace 40, the antenna assembly 20 can be tuned to provide maximum performance for any type vehicle 22. For example, the dimensions of the exemplary first trace 40 are optimized for an antenna assembly 20 mounted within an air dam at the top of one type of sport utility vehicle 22. However, an optimized first trace for an antenna assembly to be mounted inside of the bumper of a sports car might extend through eleven, not ten, Hilbert Curves.

Figure 8:
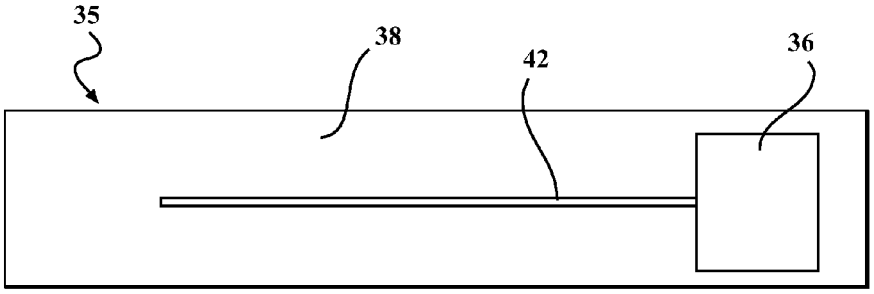
FIG. 8 is a bottom view of the exemplary printed circuit board.

Typically, antennas for receiving DAB radio signals or remote keyless entry signals, which are typically in the range of 174 MHz to 315 MHz, are shorter than antennas for receiving AM, FM or HD radio signals. As such, as shown in FIG. 8, a second trace 42 is printed on a second surface of the antenna section 38 of the printed circuit board 35 for receiving DAB radio signals and/or remote keyless entry signals. In order to minimize the size of the printed circuit board 35, and thus the antenna assembly 20, the second trace 42 the second surface with the second trace 42 is on the opposite side of the antenna section 38 from the first surface with the first trace 40 discussed above. The inclusion of the second trace 42 allows the vehicle manufacturer to have an external antenna element for the remote keyless entry system and/or for receiving DAB radio signals at only the cost of printing the additional trace on the existing printed circuit board 35. Such an external remote keyless entry antenna may have a greater range than an internal antenna. Additionally, the first and second traces 40, 42 may be electrically connected to one another and configured to resonate with one another to provide a single input signal to the amplifier section 36 of the printed circuit board.

Figure 9:
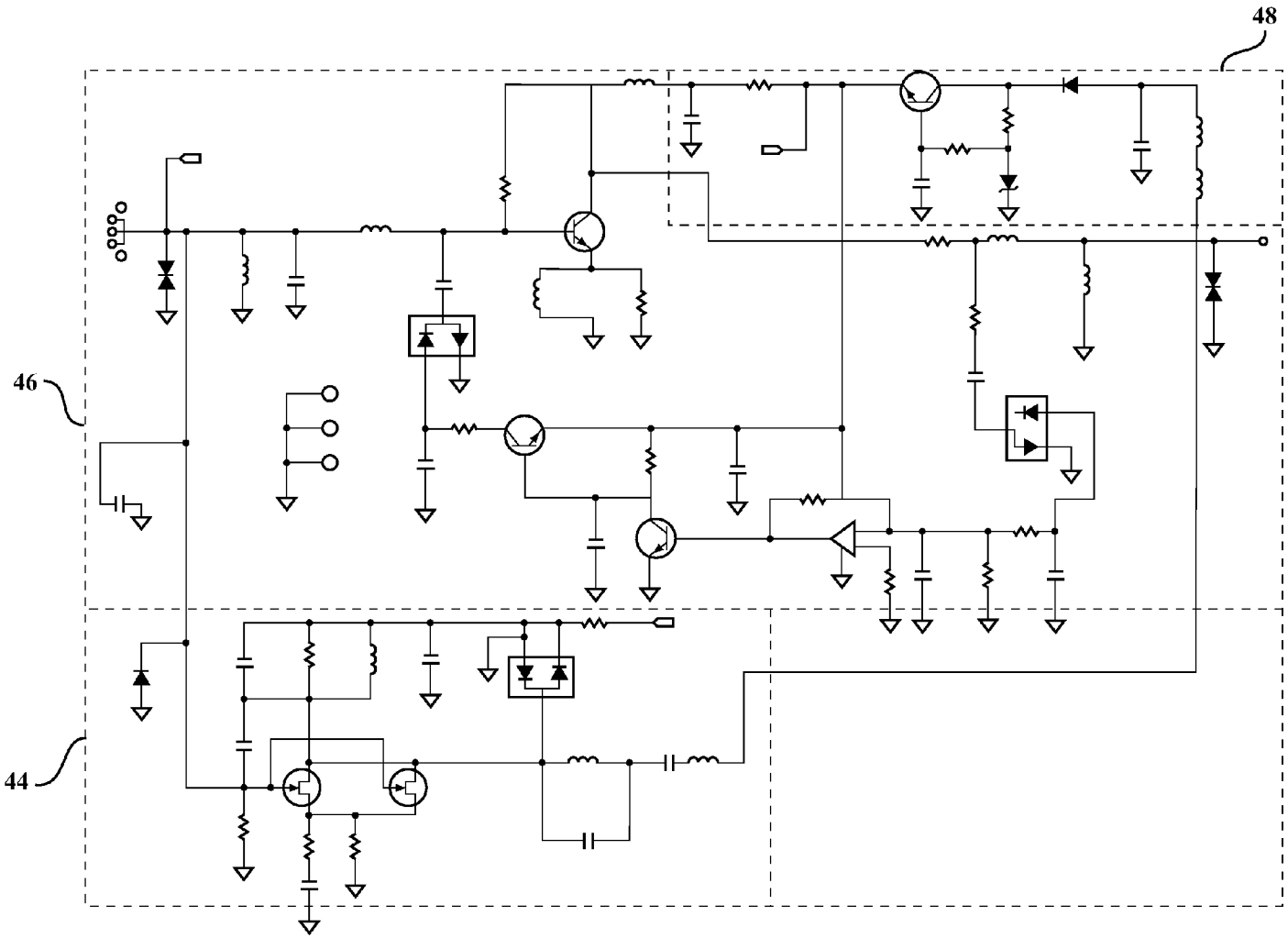
FIG. 9 is an electrical schematic drawing of the exemplary AM, FM and Supply blocks of an amplifier section of the exemplary printed circuit board.

As discussed above, the printed circuit board 35 includes an amplifier section 36 for amplifying signals received by the first and second traces 40, 42 on the antenna section 38. Referring now to FIG. 9, an electrical schematic drawing of the AM block 44, the FM block 46 and the Supply block 48 of the exemplary amplifier section 36 are shown. It should be appreciated that the amplifier section 36 could also include a DAB block, a remote keyless entry block or any additional blocks for amplifying other signals.

Various tests of the exemplary antenna assembly 20 were performed with the antenna assembly 20 mounted inside of a non-metallic spoiler of a vehicle 22. FIG. 10 shows the results of the AM and FM amplifier gain tests. The AM amplifier gain tests were taken at 530 and 1,710 kHz, and the FM amplifier gain tests were taken at 87.9 and 107.9 MHz. FIG. 10 shows the results of FM amplifier noise tests. The FM amplifier noise tests were taken at 87.9 and 107.9 MHz. As shown from these Figures, the exemplary antenna assembly 20 has a high power gain throughout the FM and AM frequency ranges and a low noise figure throughout the FM frequency range.

Various tests were also taken with the exemplary antenna assembly 20 mounted inside of an air dam of a sport utility vehicle. FIG. 11 shows the results of FM passive gain tests, and FIG. 12 shows the results of FM active gain tests. Both the FM passive and active gain tests were taken at 88.0, 90.0, 92.0, 94.0, 96.0, 100.0, 102.0, 104.0, 106.0 and 107.8 MHz. FIG. 13 shows the results of AM passive gain tests, and FIG. 14 shows the results of AM active gain tests. The AM passive and active gain tests were taken at 560, 760, 1270 and 1600 kHz.

Obviously, many modifications and variations of the present invention are possible in light of the above teachings and may be practiced otherwise than as specifically described while within the scope of the appended claims.

What is claimed is:

1. An antenna assembly for a vehicle including a non-metallic structure comprising:

an environmentally sealed housing for disposal in the non-metallic structure of the vehicle;

a printed circuit board disposed at least partially within said environmentally sealed housing and including a first trace extending through a plurality of second order Hilbert Curves for receiving at least one of amplitude modulation (AM) and frequency modulation (FM) and high definition (HD) radio signals;

further including an amplifier disposed in said environmentally sealed housing and in electrical communication with said first trace on said printed circuit board for amplifying at least one of AM, FM and HD radio signals received by said first trace; and wherein said first trace for receiving radio signals is disposed on a first surface of said printed circuit board and wherein said printed circuit board further includes a second trace printed on a second surface of said printed circuit board opposite of said first surface.

2. The antenna assembly as set forth in claim 1 wherein said plurality of second order Hilbert Curves of said trace are arranged in side-by-side relationship with one another.

3. The antenna assembly as set forth in claim 1 wherein said second trace is for receiving at least one of a digital audio broadcast (DAB) radio signal and a remote keyless entry signal.

4. The antenna assembly as set forth in claim 1 wherein said first and second traces are configured to resonate with one another and wherein said first and second traces are electrically connected to one another to present a single input signal for said amplifier.

5. The antenna assembly as set forth in claim 1 wherein said first trace is optimized to receive radio signals in the range of 520 KHz to 108 MHz.

6. The antenna assembly as set forth in claim 5 wherein said second trace is optimized to receive radio signals in the range of 174 MHz to 315 MHz.

7. The antenna assembly as set forth in claim 1 wherein said environmentally sealed housing is generally rectangular.

8. An antenna assembly for a vehicle including a non-metallic structure comprising:

an environmentally sealed housing for disposal in the non-metallic structure of the vehicle; and a printed circuit board disposed at least partially within said environmentally sealed housing and including a first trace extending through a plurality of second order Hilbert Curves for receiving a first radio signal that is at least one of an amplitude modulation (AM) and a frequency modulation (FM) and a high definition (HD) radio signal and including a second trace which is shaped and sized to resonate in the range of 174 to 315 MHz.

9. The antenna assembly as set forth in claim 8 wherein said second trace is for receiving at least one of digital audio band (DAB) radio signals and a remote keyless entry signal.

10. The antenna assembly as set forth in claim 8 further including an amplifier disposed in said environmentally sealed housing and in electrical communication with said first and second traces.

11. The antenna assembly as set forth in claim 8 wherein said first and second traces are configured to resonate with one another and wherein said first and second traces are electrically connected to one another to present a single input signal for said amplifier.

12. The antenna assembly as set forth in claim 8 wherein said first trace is configured to receive radio signals in the range of 520 KHz to 108 MHz.

13. The antenna assembly as set forth in claim 8 wherein said plurality of Hilbert Curves are arranged in side-by-side relationship with one another.

14. The antenna assembly as set forth in claim 8 wherein said environmentally sealed housing is generally rectangular.

15. An antenna assembly for a vehicle including a non-metallic structure comprising:

an environmentally sealed housing for disposal in the non-metallic structure of the vehicle;

a printed circuit board disposed at least partially within said environmentally sealed housing and including a first trace extending through a plurality of second order Hilbert Curves for receiving a first radio signal that is at least one of an amplitude modulation (AM) and a frequency modulation (FM) and a high definition (HD) radio signal and including a second trace which is optimized to receive a second radio signal that is in the range of 174 to 315 MHz; and wherein said first and second traces are disposed on opposite sides of said printed circuit board.

* * * * *